US006151926A

United States Patent [19]

Leeke et al.

[11] Patent Number: 6,151,926

[45] Date of Patent: Nov. 28, 2000

[54] VEHICLE SEAT COVER

[75] Inventors: Gary John Leeke, Sterling Heights; Debra Jean Tiensivu, Clinton Township, Macomb County, both of Mich.

[73] Assignee: Lear Corporation, Southfield, Mich.

[21] Appl. No.: 09/107,922

[22] Filed: Jun. 30, 1998

[51] Int. Cl.[7] ..... D04B 1/22

[52] U.S. Cl. ..... 66/170; 66/198

[58] Field of Search ..... 66/171, 170, 196, 66/198, 202; 297/218.1, 218.4, 226, 225, 452.59

[56] References Cited

U.S. PATENT DOCUMENTS 5,209,084 5/1993 Robinson et al. ..... 66/196
5,213,863 5/1993 Day et al. ..... 66/198
5,235,826 8/1993 Brooks et al. ..... 66/202
5,308,141 5/1994 Robinson et al. ..... 66/198
5,326,150 7/1994 Robinson et al. ..... 66/198
5,682,771 11/1997 Forest et al. ..... 66/198
5,749,247 5/1998 Jeffcoat ..... 66/198

*Primary Examiner*—Danny Worrell
*Attorney, Agent, or Firm*—Brooks & Kushman P.C.

[57] ABSTRACT

A vehicle seat fabric cover (1) and a method of knitting the cover knitted from yarn (31–33) in generally a double jersey construction for covering a seat, the cover having an exposed front layer (12) and a rear layer (21) having formed integrally therewith a first coursewise extending single jersey tubular portion (22) with a second coursewise extending single jersey tubular portion (23) adjacent thereto, both tubular portions (22,23) being connected to the front layer (12) in the same course or adjacent courses.

4 Claims, 4 Drawing Sheets

31
R
F
32
33
51
52
53
54
55
56
57
58

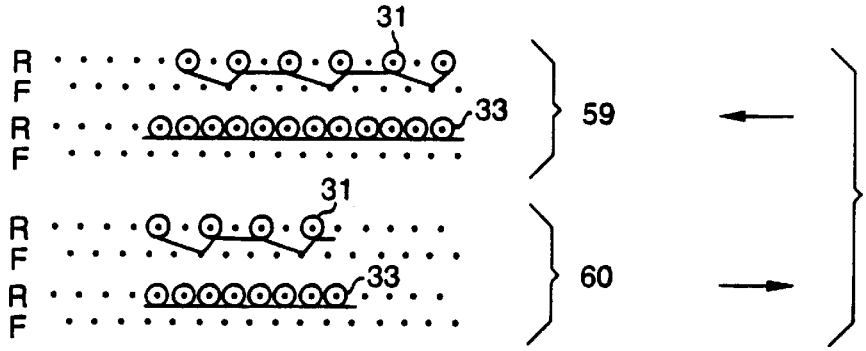
Fig.3(E).
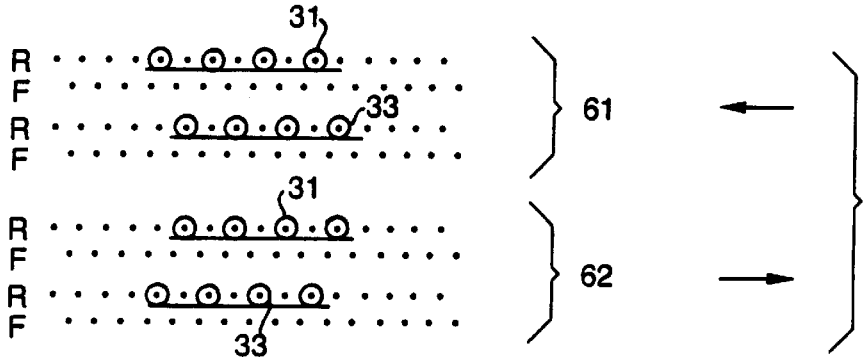
Fig.3(F).
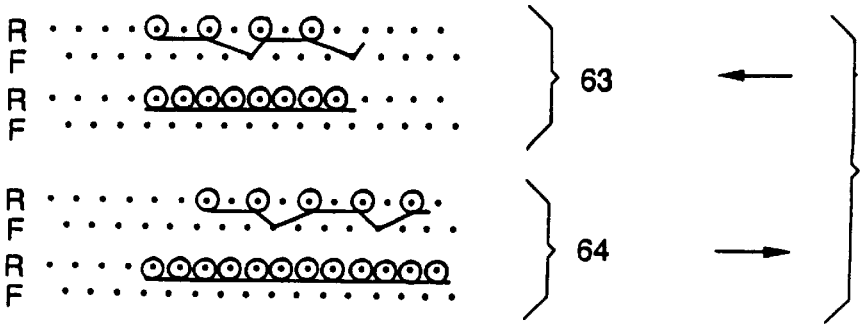
Fig.3($G_1$).

Fig.4($G_2$).

VEHICLE SEAT COVER

TECHNICAL FIELD

This invention relates to vehicle seat covers and in particular to seat covers which are made by continuous three dimensional knitting.

BACKGROUND OF THE INVENTION

Motor vehicles, in particular motor cars, are now commonly provided with air bag restraints to prevent the vehicle passengers or driver being injured during collisions. Some vehicles are provided with air bags which in their stand-by condition are housed within a vehicle seat back or base.

On conventional seats when the air bag is activated and inflated, it escapes through the seat cover by bursting through the sewn seams where portions of the cover are sewn together. Some seat covers are provided with air bag guides which direct the inflating air bag towards the seam through which it is intended to burst.

Three dimensional seat covers are completely homogeneous and, therefore, in order to provide a knitted cover which splits or bursts in a predictable manner, the cover is knitted with a coursewise line of weakness through which the air bag can burst. This seat cover is described in the applicants' U.S. Pat. No. 5,682,771, the contents of which are hereby incorporated into the present invention.

If the seat back and base comprise bolsters, it is necessary to provide anchorage devices on the underside of the seat covers to shape the cover to the upper surface of the bolster. The anchorage device is typically an open-ended tubular portion of knitted fabric which is formed integrally by knitting, as is described in U.S. Pat. No. 5,308,141 and U.S. Pat. No. 5,326,150.

The air bag burst line may be formed close to the anchorage device so that the cover is held against outward movement as the air bag inflates.

SUMMARY OF THE INVENTION

The present invention provides a means for attachment of air bag inflation guides, or other devices, on the inner side of a seat cover.

According to the present invention, there is provided a vehicle seat fabric cover knitted from yarn in generally a double jersey construction for covering a seat core containing an inflatable air bag, the cover having an exposed front layer and a rear layer adjacent the core, and having formed integrally therewith a first coursewise extending single jersey tubular portion in the rear layer, with a second coursewise extending single jersey tubular portion also being formed in the rear layer adjacent the first tubular portion, both tubular portions being closed along the same course line or adjacent course lines.

The seat core may be the seat cushion or the seat back as is desired.

Preferably, the first tubular portion is an anchorage device for securing the cover to the core.

The second tubular portion may be shorter than the first portion and may be used for the attachment of an air bag inflation guide or for other requirements.

The single jersey tubular portions may be in part connected to the front layer by tuck stitches. The advantage of this is that the connections to the front layer are not visible from the front.

Also according to the invention there is provided a vehicle seat having a cover according to the present invention and further including a seat core having an air bag located within the cushion, the cover having a designated air bag burst zone through which an air bag bursts on inflation, wherein the seat has guide means attached to the underside of the cover to direct an inflating bag towards the burst zone, said guide means being attached to the second tubular portion on the rear layer of the cover.

According to another aspect of the invention, there is provided a method of knitting a fabric cover of a generally double jersey construction on a flat "V" bed knitting machine having a front needle bed for knitting the front layer of the fabric and a rear needle bed for knitting the rear layer of the fabric, the method including knitting a double jersey fabric on both needle beds, and at a predetermined course of knitting the front needle bed is held up, and knitting continues on selected needles on the rear needle bed for a plurality of courses. After said plurality of courses, yarn is looped around selected needles on the front needle bed. Knitting then continues on the rear needle bed for a further plurality of courses and after said further courses yarn is looped around selected needles on the front needle bed. Thereafter knitting continues on both needle beds.

Preferably, the fabric is knitted on a machine having 7–14 needles per inch, preferably 12 needles per inch. The double jersey fabric is knitted from at least one yarn which is an air textured polyester yarn having a decitex in the range of 500–800 decitex, and/or a chenille yarn of the type disclosed in U.S. Pat. No. 5,428,969 which has a ground yarn in the range 550–900 decitex and a chenille yarn having a decitex in the range 1700–5000.

BRIEF DESCRIPTION OF THE DRAWINGS

The present invention will now be described, by way of example, with reference to the accompanying drawings, in which.

DESCRIPTION OF THE PREFERRED EMBODIMENT

In order that the invention can be more fully understood, reference is made to a flat V-bed knitting machine. Flat V-bed machines are well known and many such machines are computer controlled. It has been proposed to manufacture upholstery fabric on such machines in particular for use on vehicle seats (see for example U.S. Pat. No. 5,308,141 and U.S. Pat. No. 5,326,150)

The knitting of a fabric cover according to the invention uses a Stoll CMS machine or a Shima Seiki SES machine with 12 gauge needles. This machine is a flat V-bed machine which is provided with a presser foot means, or other device, to assist take-down of the knitted fabric. The machine can operate with a plurality of different yarns, each of which is associated with a respective cam box. The cam box traverses the needle beds supplying yam to needles as desired in each direction of travel.

Figure 1:
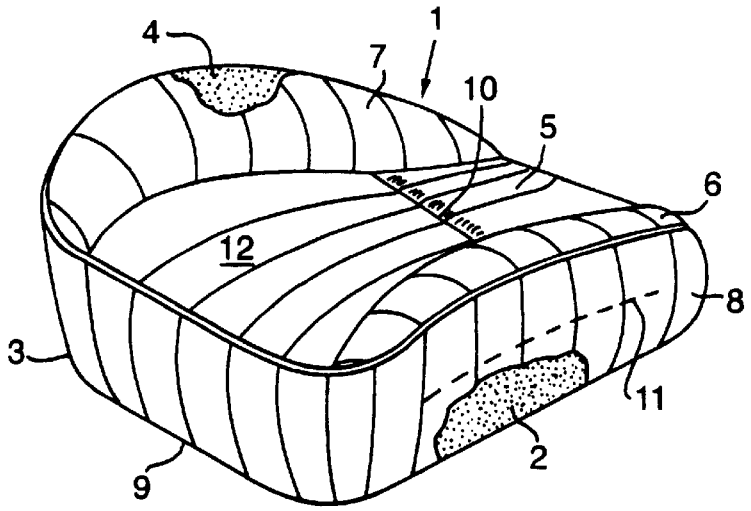
FIG. 1 is a seat cushion including a weakened bursting zone for an inflatable air bag.

With reference to FIG. 1, there is shown a seat cushion or squab generally indicated by 1. The seat cushion 1 is formed by the covering of a core 2, normally in the form of semi-rigid foam supported on a frame, with a fabric cover 3. The core 2 is provided with wings 4 or shaped as desired for the seat. When used in motor vehicles, in particular motor cars, the seat frame may support an inflatable air bag mechanism which is operated in a collision, perhaps a side impact.

The cover 3 stretched over the core 2 has integral wing portions 6,7, side portions 8 and a front portion 9. The fabric cover is folded around the frame and may be secured thereto in a known manner. The seat may have indentations 10 formed therein for aesthetic effect.

The cover 3 is of a generally double jersey knitted construction and is a three dimensional continually knitted cover having an exposed layer 12 and a rear layer 21 adjacent the core 2. In order to aid or control the bursting of the air bag, a line of weakness 11 is provided which extends in a coursewise direction of knitting in the fabric. This is described in U.S. Pat. No. 5,628,771.

Figure 2:
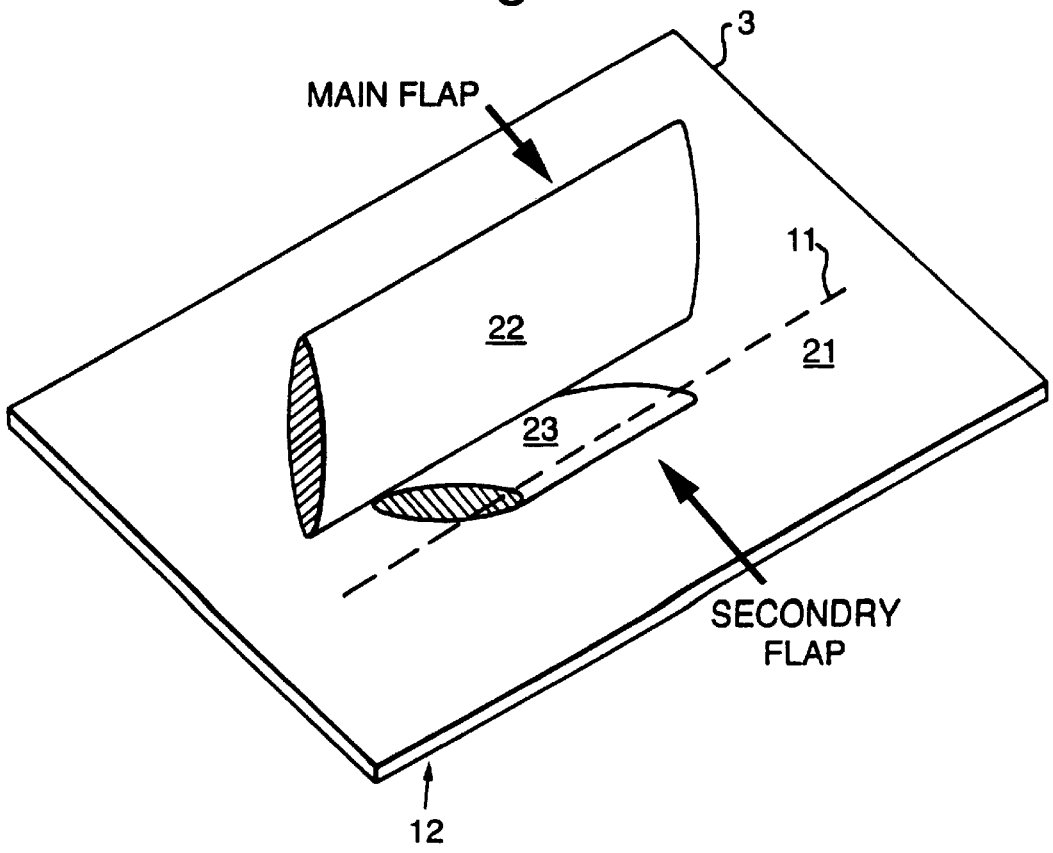
FIG. 2 is an isometric view of a portion of the rear face of the seat cushion cover of FIG. 1.

With reference now to FIG. 2, there is shown in rear view a portion of the cover 3 having on its rear face 21 a coursewise extending tubular portion 22 which in use may serve as an anchorage device for securing the cover to the support. The anchorage device could be arranged close to the burst line 11 so as to secure the cover against outward movement. In order to guide the inflating bag towards the burst line, the seat may include guide members in the form of belting or webbing which is attached to a second coursewise extending tubular portion 23. The second tubular portion 23 has a shorter coursewise length than the first tubular portion 22, and in some cases there may be a plurality of second tubular portions 23 spaced along the length of the first tubular portion 22.

Figures 3A, 3B, 3C, 3D:
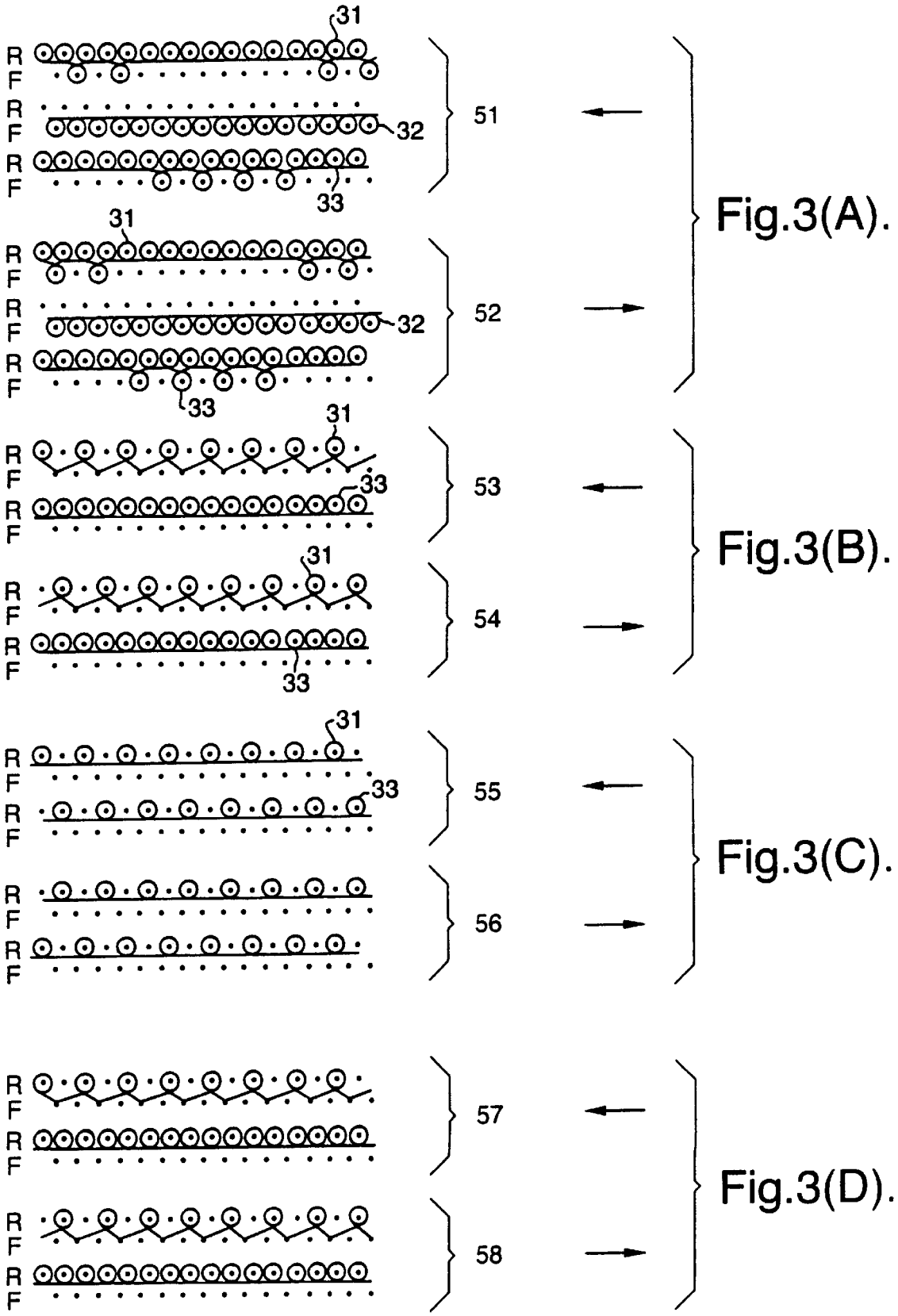
FIG. 3 is a knitting diagram showing a first stitch structure for knitting the two tubular portions shown in FIG. 2.
Figure 4H:
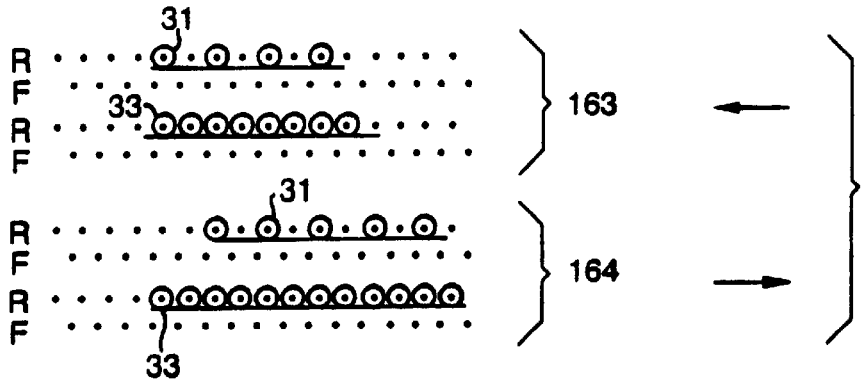
FIG. 4 is a knitting diagram showing an alternative method of closing a single jersey tubular portion.
Figure 4H:
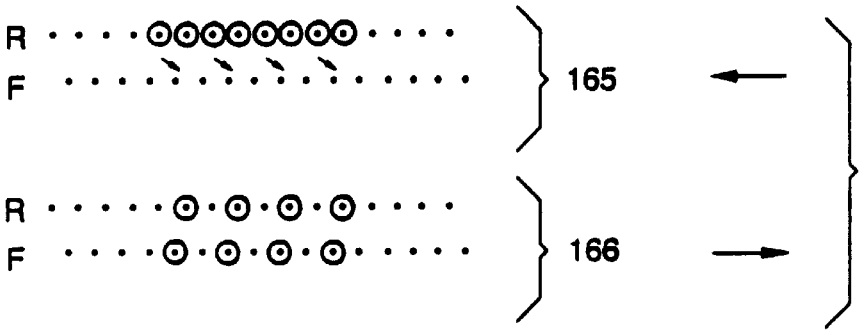

With reference to FIG. 3, there is shown a knitting diagram for a knitting method according to the invention. Knitting of the fabric which is of a generally double jersey construction takes place on a flat "V" bed knitting machine having a front needle bed for knitting the front layer of fabric and a rear needle bed for knitting the rear layer of fabric. The needle beds are shown schematically in FIG. 3 and each dot represents a needle, the lower row F representing the front needle bed and the upper row R representing the rear needle bed. The arrow shows the direction of traverse of the machine yarn carrier.

A mainly double jersey construction fabric is knitted on both needle beds R and F, and a single course 51 comprises one pass of the cam box in one direction, leftwards, as illustrated, which takes with it the yarn carrier(s) with the yarn(s) to be knitted. Three yam carriers deliver an air textured polyester yarn 31, which may be space dyed, for knitting on the rear needle bed R, a chenille polyester yarn 32 for knitting on the front needle bed F, and a second air textured polyester yarn 33 also for knitting on the rear needle bed R. The yarns 31, 33 on the rear bed are occasionally knitted on the front face of the fabric by looping around the front bed needles for the effect of pattern and to hold the two layers together.

The return pass of the cam box, rightwards, forms a second course 52 of knitting which is substantially identical with the previous course 51. The two courses 51,52 form a machine repeat unit A. The double jersey material is knitted for a desired number of machine repeat units A.

When it is desired to form the first tubular portion 22, the front needle bed F is held up, and knitting continues on selected needles on the rear needle bed R as is required for the desired length of tubular portion 22. Only the yarns 31 and 33 are knitted to form two set-up courses 53, 54. The yarn 31 is knitted on alternate needles on the rear bed and the yarn 33 is knitted on all needles on the rear bed so that the two courses 53, 54 comprise three complete rows knitted on the rear needle bed R which are knitted for only one machine knit unit B. The yarn 31 is connected to the front needle bed F on alternative needles using tuck stitches, and the two courses 53, 54 form with the yarn 31 a complete row of stitches on the rear needle bed. The tuck stitches will be invisible on the front layer of the material.

After the set-up courses 53, 54, the first tubular portion 22 is knitted as a single jersey construction in polyester yarns 31, 33 on half gauged needles for a desired number of machine repeats units C, made up of courses 55, 56. The number of repeat units C could be between 12 and 20 as is required.

After the desired number of repeat units C, the first tubular portion 22 is closed by means of a single knit unit D, comprising two courses 57, 58, and which is identical to the set-up knit unit B, so that the single fabric tubular portion 22 is connected to the front layer of the fabric by tuck stitches.

Knitting then commences to form the single jersey second tubular portion 23. The first knit unit E comprises set-up courses 59, 60. In the first course 59, the yarns 31, 33 are taken leftwards as far as is required for the desired length of the second tubular portion 23, and on the return move rightwards only as far as is required for said desired length. The knitted structure is similar to unit B, except that the yarn 31 preferably forms tuck stitches with every fourth needle on the front needle bed.

The second tubular portion is then knitted in single jersey construction. The single jersey repeat unit F comprising courses 61,62 is similar in structure to unit C. The unit F is knitted for a desired number of repeats, between four and 24, and the second tubular portion 23 is then closed.

The second tubular portion 23 is closed to the front layer in a similar manner to the first tubular portion 22. The closure is made by knitting the machine unit G, comprising courses 63,64, which are a reverse of the procedures used to form unit E.

Thereafter, knitting of the double jersey construction material continues by knitting on both needle beds in a manner similar to unit A.

In an alternative arrangement, the two tubular portions 22, 23 could be formed by knitting the machine units in the order of A,E,F,G,D,C,B forming the shorter tubular portion 23 first, followed by the longer tubular portion 22.

In an alternative method, the second tubular portion 23 is knitted as previously described up to stage F. Thereafter the subsequent knit unit G2 comprising the last two courses 163, 164 of the second tubular portion is knitted with the yarn being knitted on alternate needles on the rear bed R and the yarn 33 being knitted on all needles with the yarn carrier being taken fully rightwards on the final pass, similar to unit G but without the formation of tuck stitches.

The second tubular portion 23 is then closed to the front needle bed as shown in unit H which comprises the non-knitting courses 165,166. Selected alternate needles cause alternate knitted loops on the rear needles to be transferred to needles on the front needle bed.

Thereafter knitting of the double jersey construction material continues by knitting on both needle beds in a manner similar to unit A.

We claim:

1. A method of knitting a fabric cover of a generally double jersey construction on a flat "V" bed knitting machine having a front needle bed for knitting the front layer of the fabric and a rear needle bed for knitting the rear layer of the fabric, the method including knitting a double jersey fabric on both needle beds, and at a predetermined course of knitting the front needle bed is held up, and knitting continues on selected needles on the rear needle bed for a plurality of courses, after said plurality of courses yarn is looped around selected needles on the front needle bed, knitting then continues on the rear needle bed for a further plurality of courses and after said further courses yarn is looped around selected needles on the front needle bed, thereafter knitting continues on both needle beds.

2. A method as claimed in claim 1 wherein after knitting the plurality of courses on the rear needle bed the yarn is looped around the selected needles on the front needle bed using tuck stitches.

3. A method as claimed in claim 2 wherein after knitting said further courses on the rear needle bed the yarn is looped around selected front needle bed using tuck stitches.

4. A method as claimed in claim 2 wherein after knitting said further courses on the rear needle bed the yarn is looped around selected front needles by transferring loops from the rear needle bed.

* * * * *